US006668736B1

(12) United States Patent
Pallo

(10) Patent No.: US 6,668,736 B1
(45) Date of Patent: Dec. 30, 2003

(54) DROP AND SLIDE ESCUTCHEON

(75) Inventor: R. David Pallo, Fairport, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 09/829,138

(22) Filed: Apr. 9, 2001

(51) Int. Cl.[7] ..... E05G 1/026

(52) U.S. Cl. ..... 109/65; 109/49.5; 109/58; 109/58.5; 109/79; 70/452; 312/409; 220/345.1

(58) Field of Search ..... 109/65, 75, 76, 109/80, 49.5, 58, 58.5, 78, 79, 82–85; 312/409; 428/921; 70/452; 220/345.1

(56) References Cited

U.S. PATENT DOCUMENTS 2,514,696 A * 7/1950 Dube ..... 109/82
4,541,545 A * 9/1985 Beattie et al. ..... 109/45
4,574,454 A * 3/1986 Dyson ..... 109/65
4,721,227 A * 1/1988 Hughes et al. ..... 109/78
5,069,358 A 12/1991 Avery, Jr. ..... 220/426
5,295,447 A * 3/1994 Robbins et al. ..... 109/65
5,377,514 A * 1/1995 Robbins et al. ..... 109/75
5,435,256 A * 7/1995 Svehaug ..... 109/65
6,210,638 B1 * 4/2001 Grieco et al. ..... 220/345.1

* cited by examiner

*Primary Examiner*—Anthony Knight
*Assistant Examiner*—Christopher Boswell
(74) *Attorney, Agent, or Firm*—Dennis B. Danella; Jaeckle Fleischmann & Mugel, LLP

(57) ABSTRACT

A drop and slide escutcheon system where the escutcheon has rims with locking members that fit into locking grooves formed in the funnels on the safe body. The escutcheon is offset by a slight amount, allowing the locking members to slide down into openings that provide access to the locking grooves in the funnel as the escutcheon is inserted into position. The escutcheon is then moved laterally, sliding the locking members into the locking grooves provided.

18 Claims, 10 Drawing Sheets

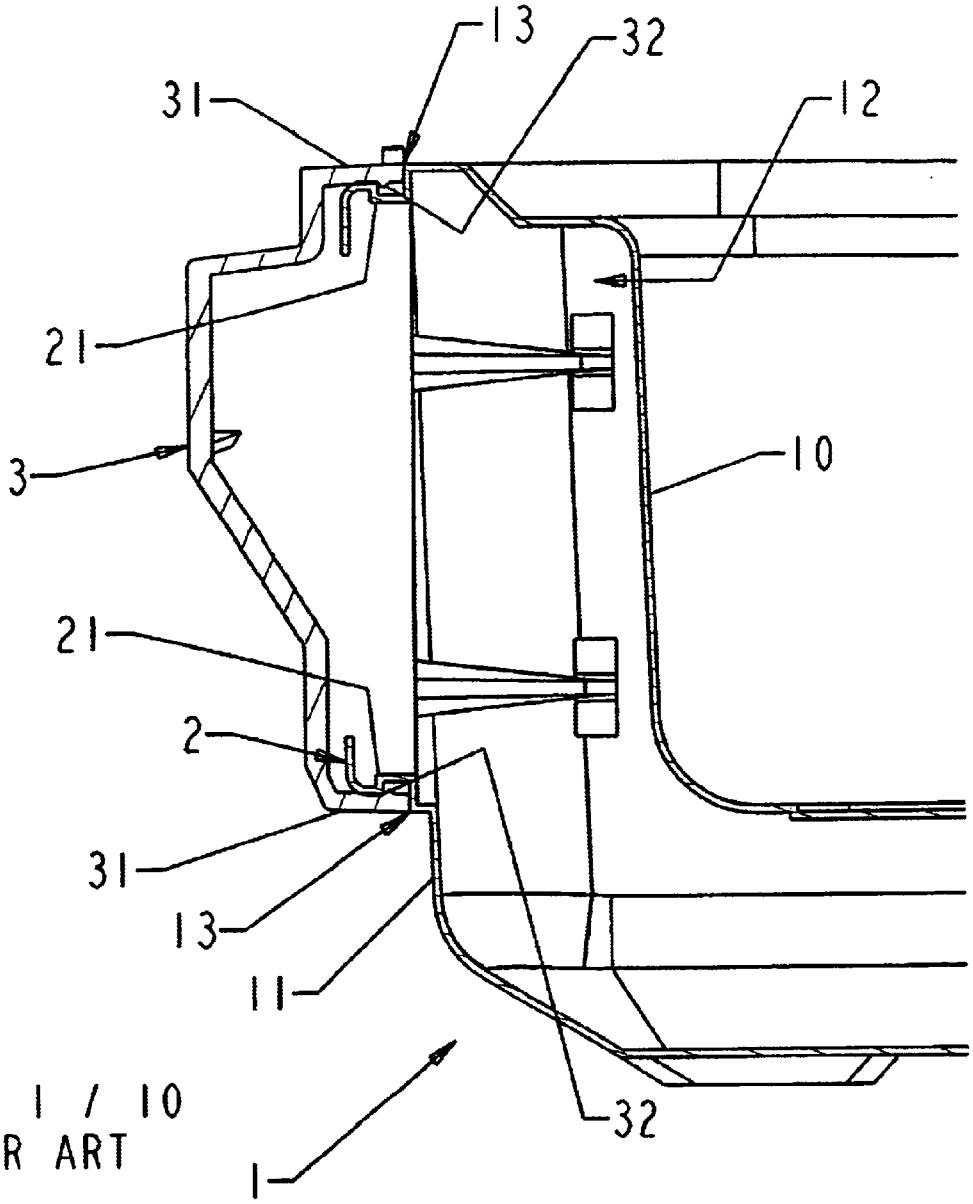
FIG. 1 / 10
PRIOR ART

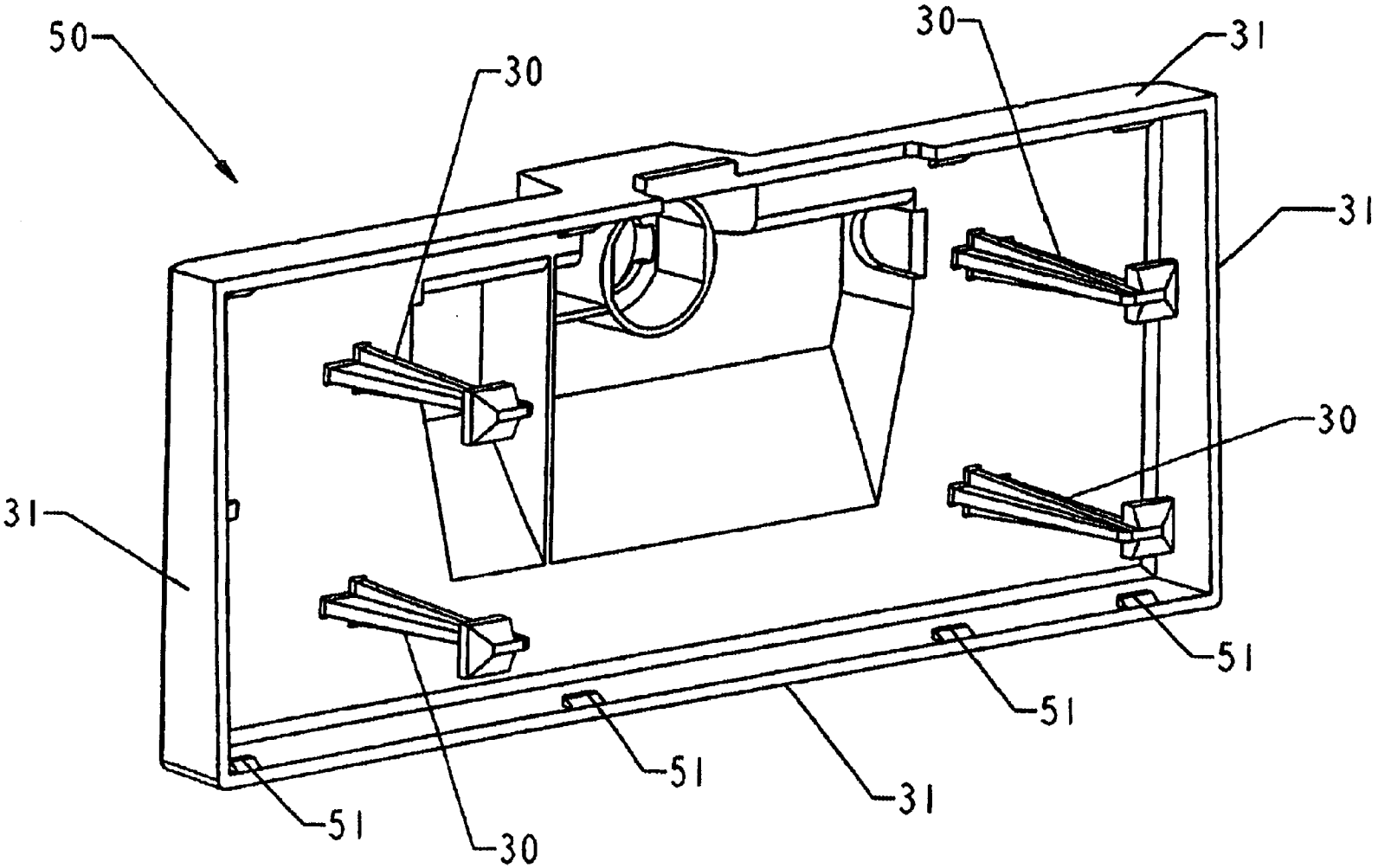
FIG. 2 / 10

FIG. 3 / 10
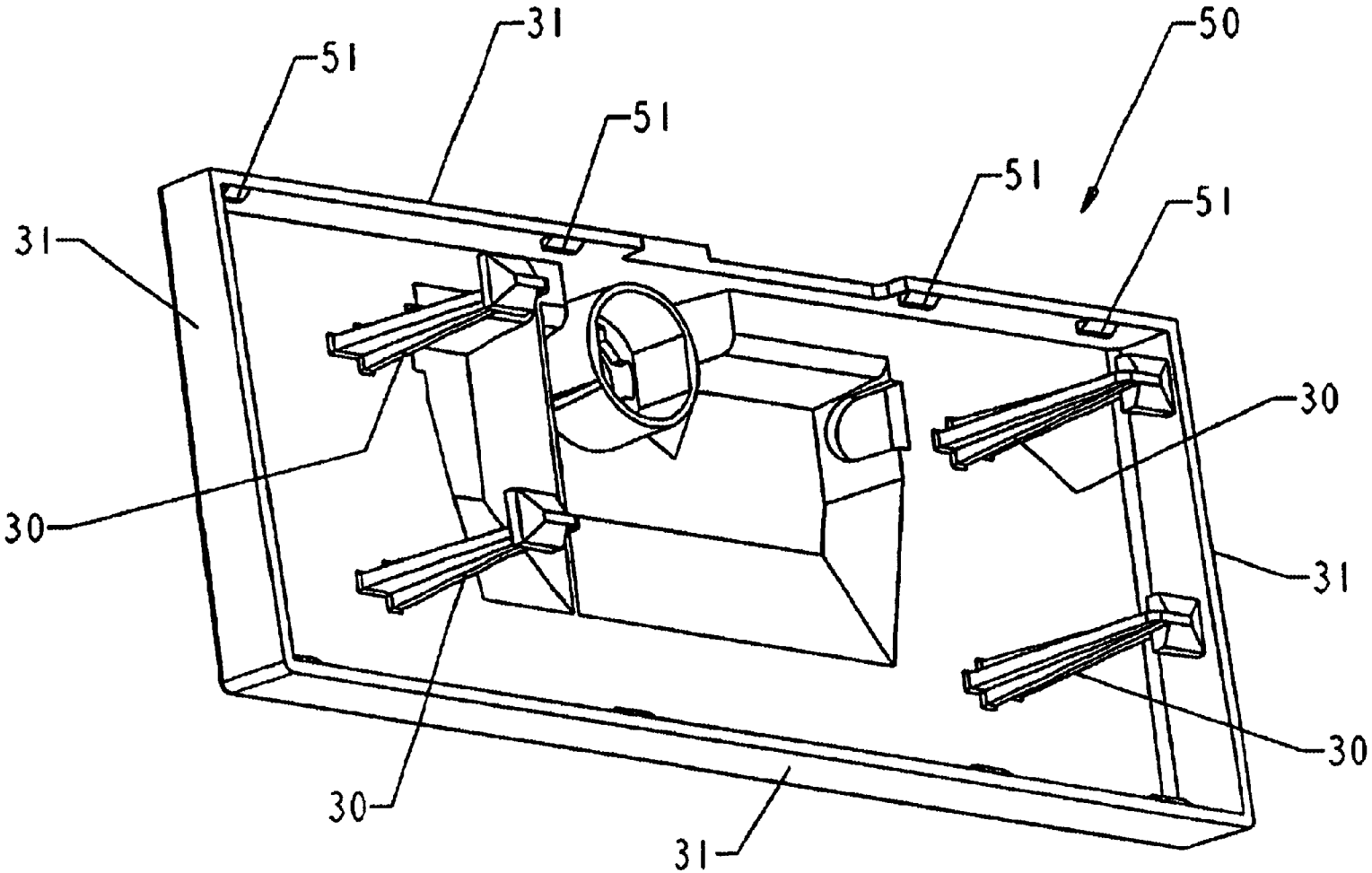

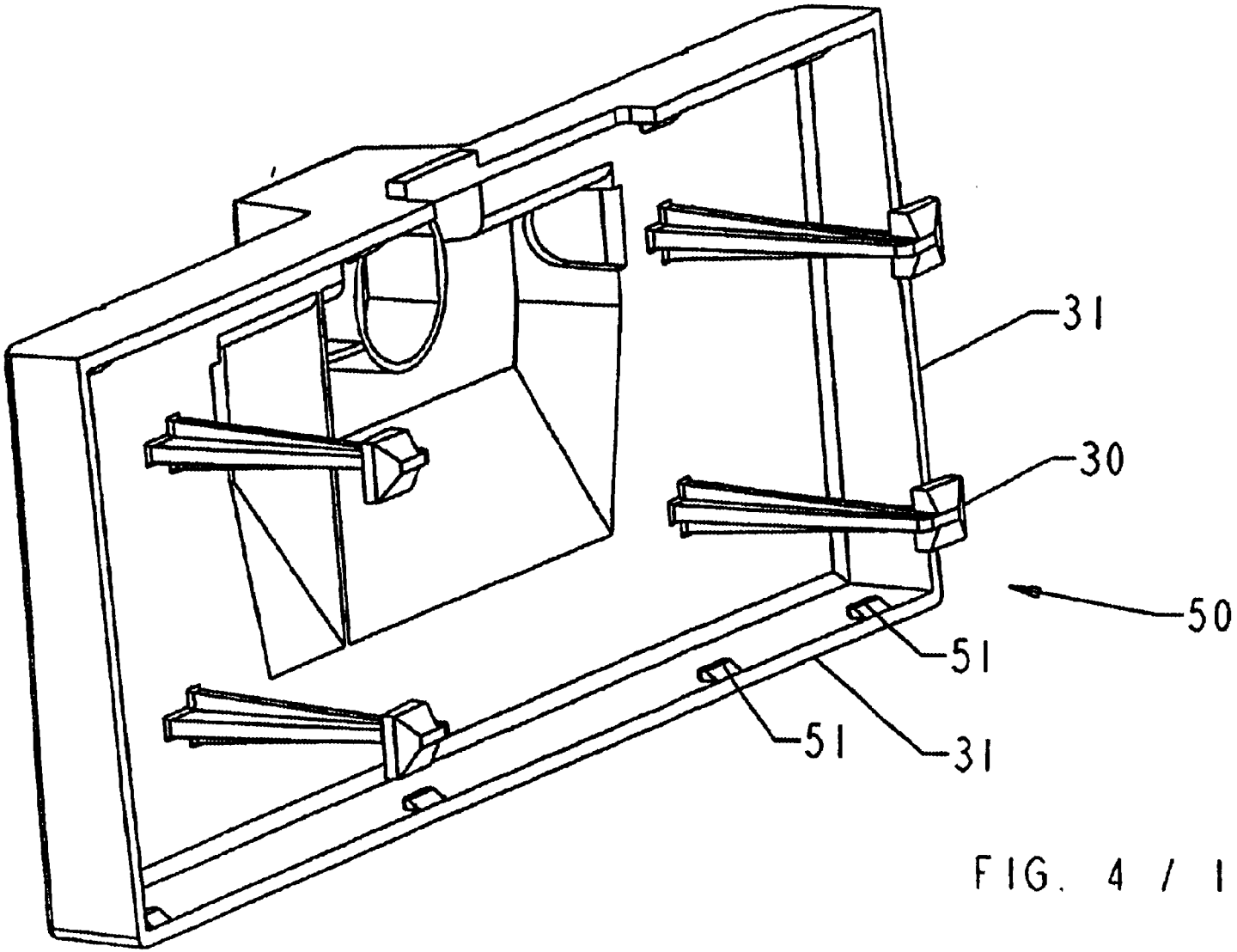
FIG. 4 / 10

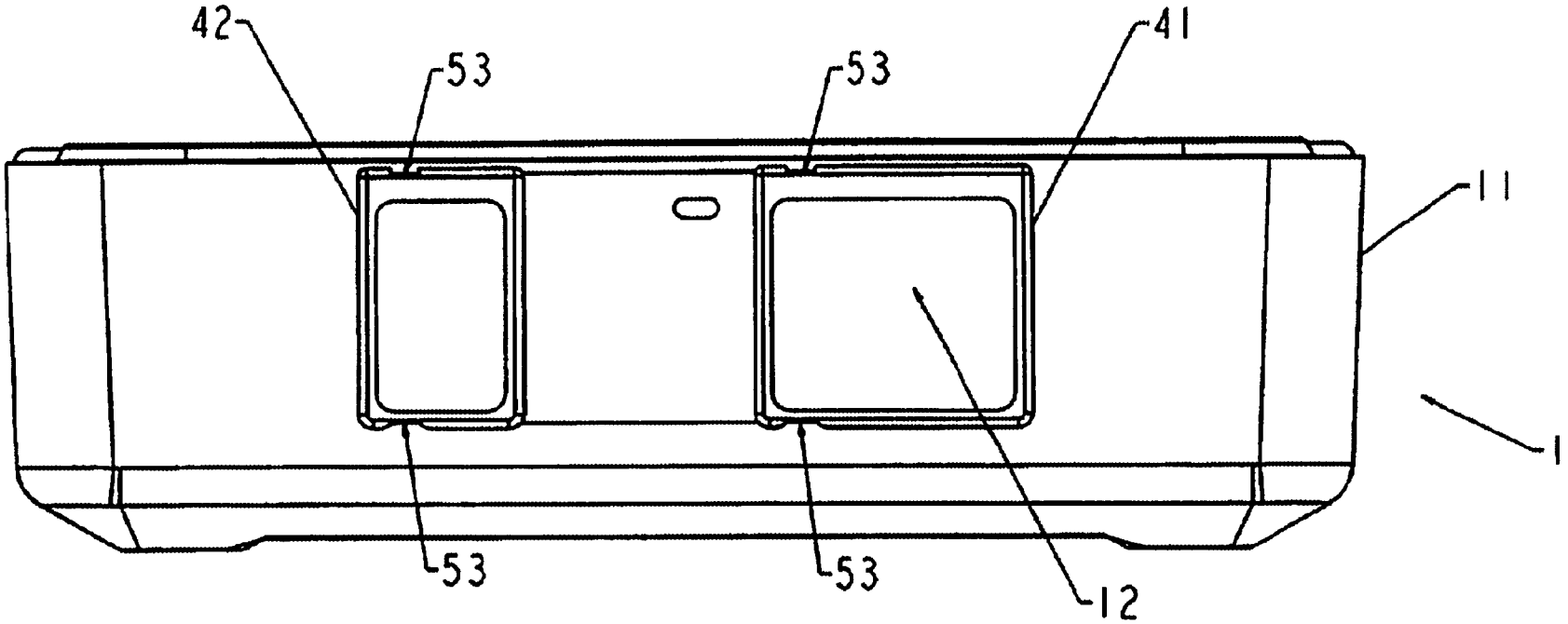
FIG. 5 / 10

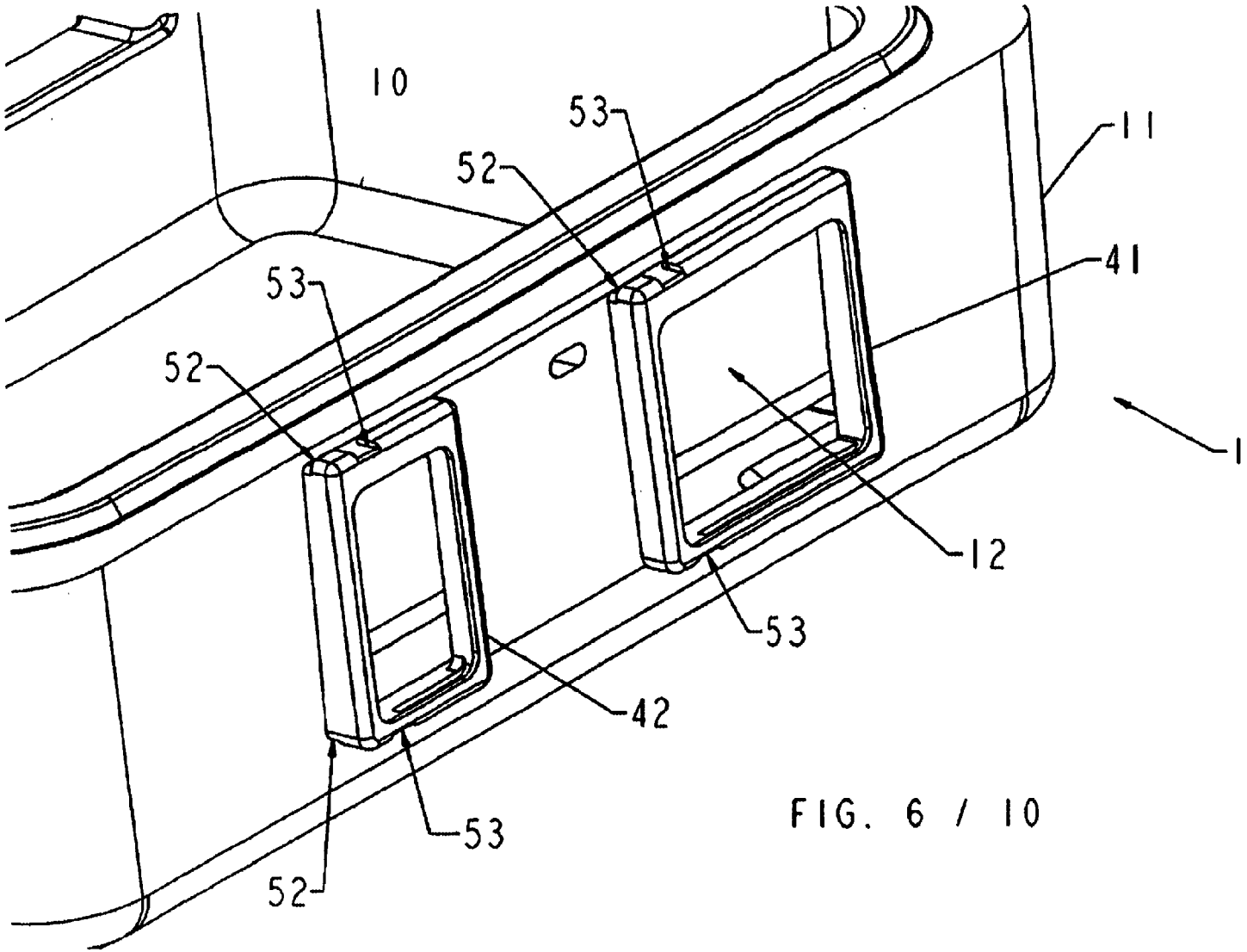
FIG. 6 / 10

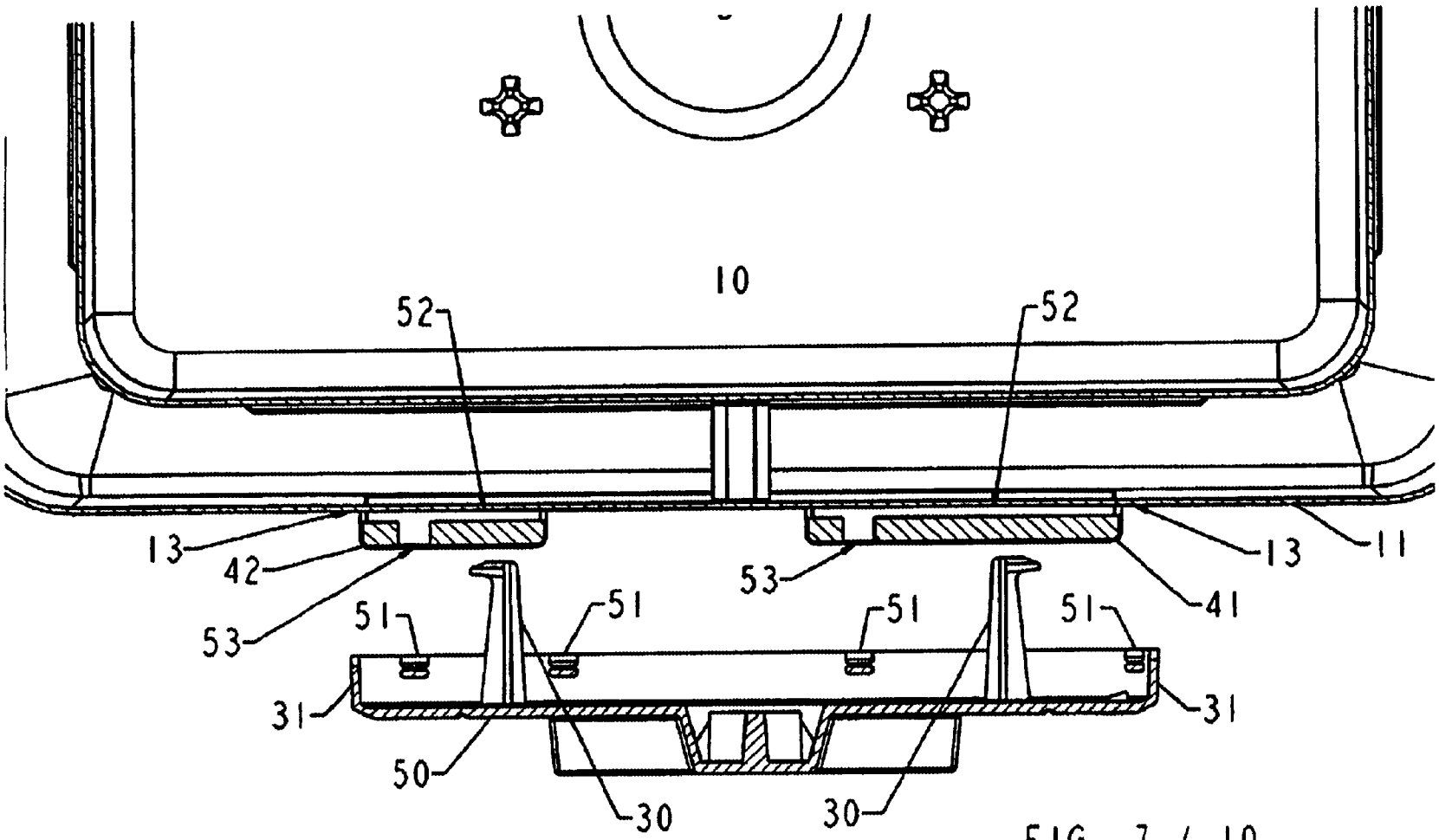
FIG. 7 / 10

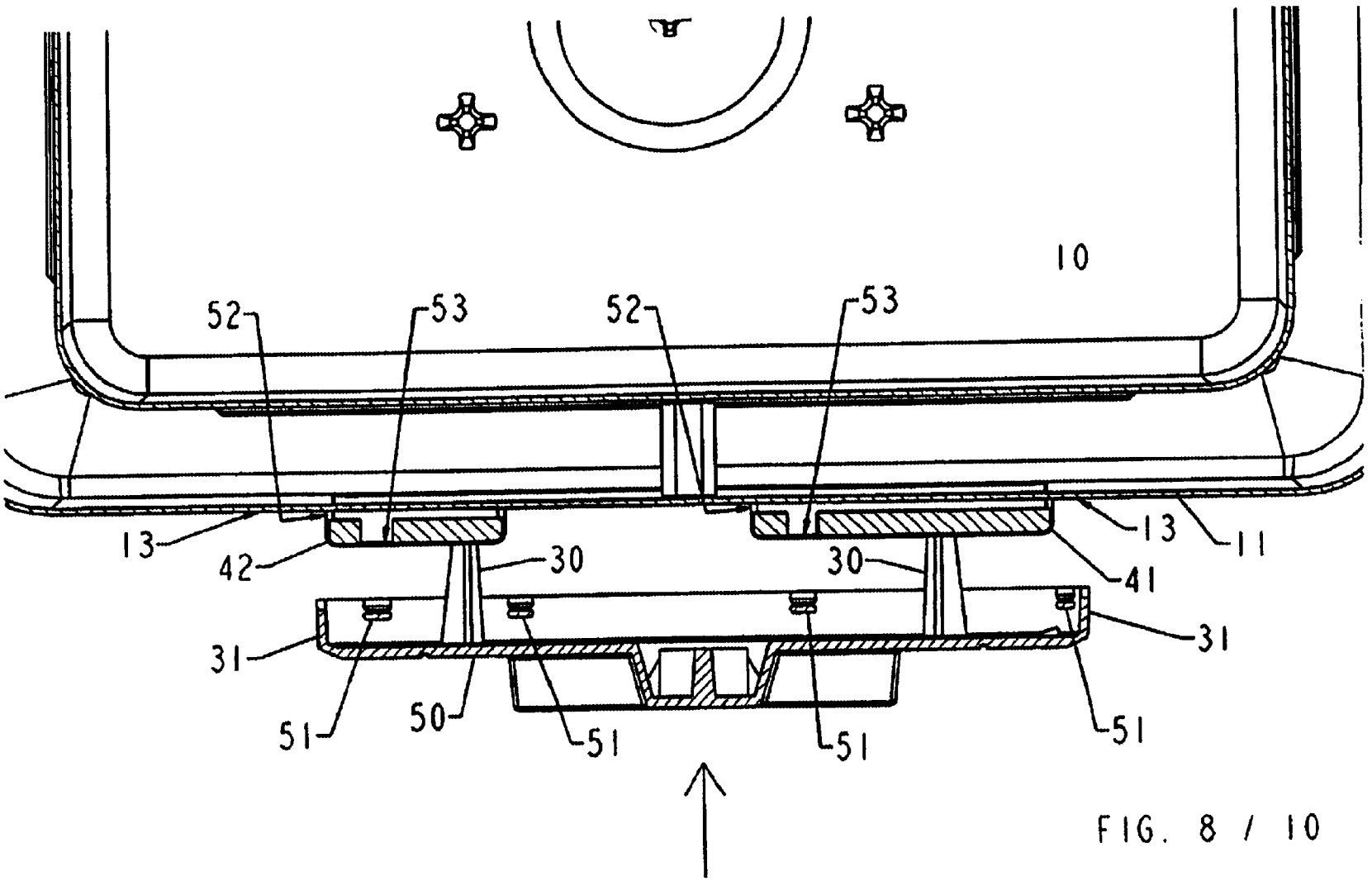
FIG. 8 / 10

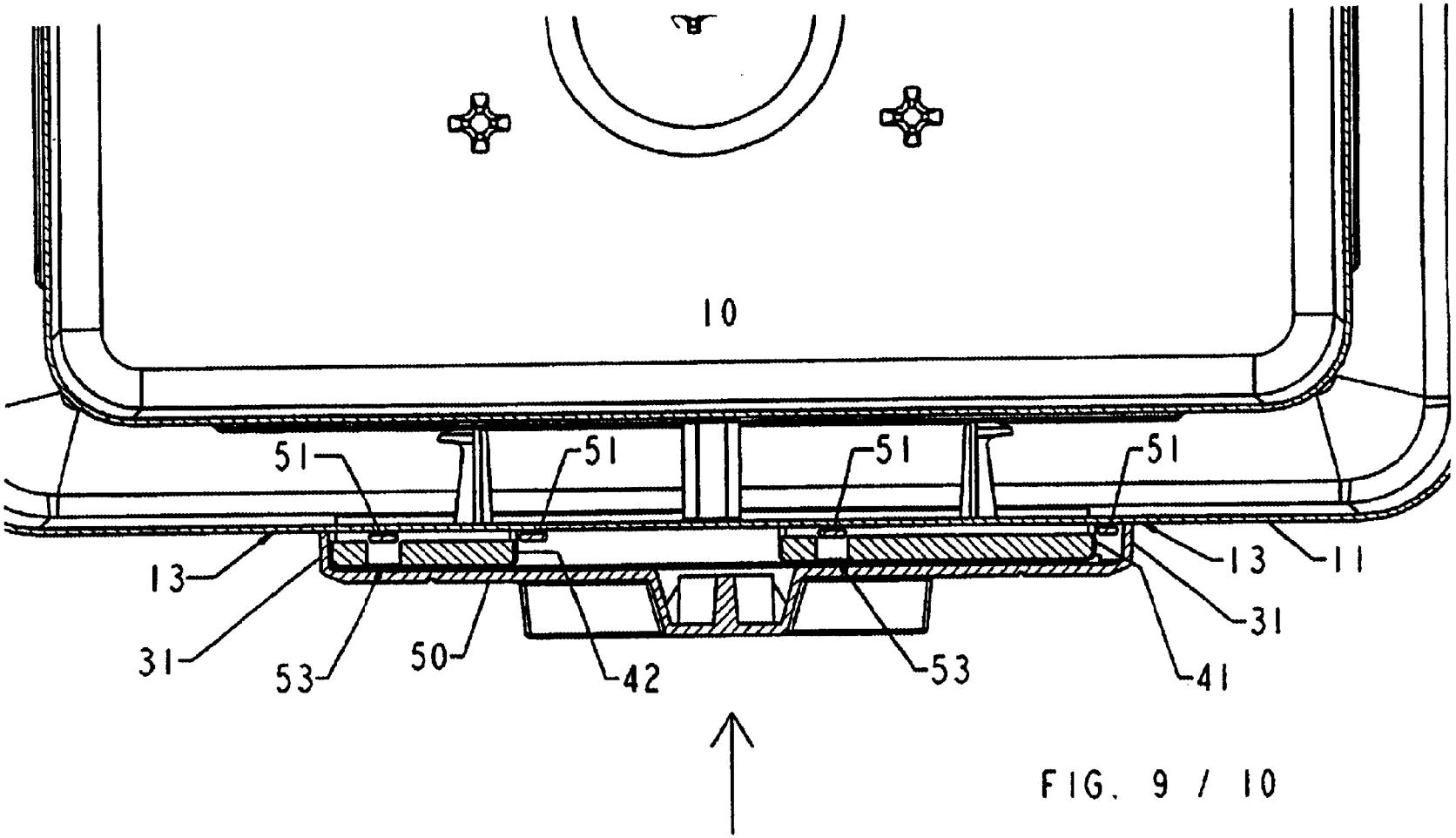
FIG. 9 / 10

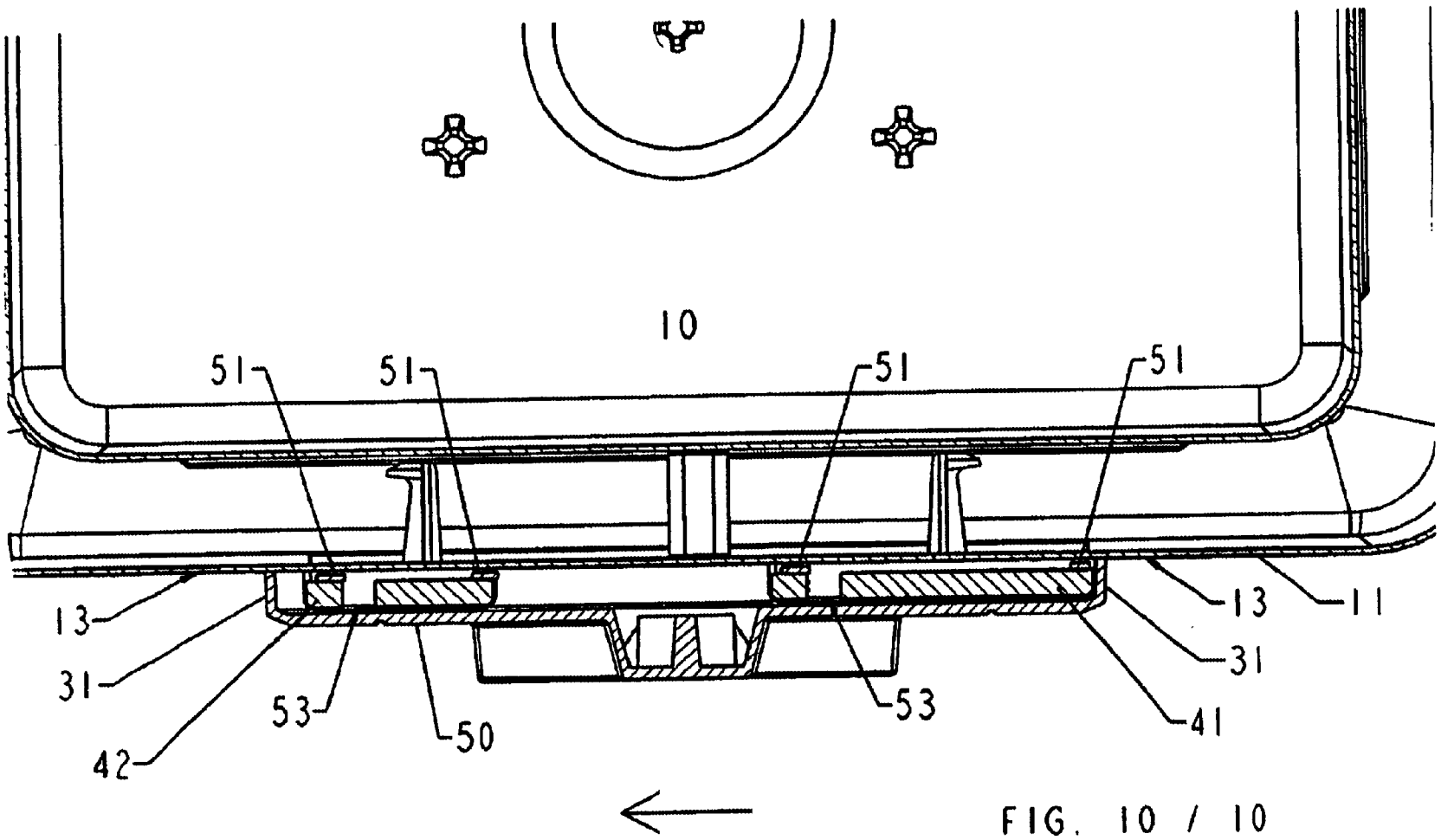
FIG. 10 / 10

DROP AND SLIDE ESCUTCHEON

TECHNICAL FIELD

My invention relates generally to the field of insulated storage containers for protecting contents from damage from fire. More specifically, it relates to the design and construction of escutcheons for use in covering the funnels in a double-walled fire-resistant safe filled with insulating material.

BACKGROUND OF THE INVENTION

Fire-resistant storage containers, also referred to as fire-resistant safes, are generally constructed with internal and external shells that encapsulate spaces filled with insulation material. The internal shells form inner surfaces of each safe lid/door or body, and the external shells form outer surfaces of each safe lid/door or body. Together, the internal and external shells form a shuttering for molding the insulating material in place within the shells. The insulating material is generally made of a concrete mixture that solidifies in the mold but retains a large amount of water within the solidified mass of material.

Each of the double-walled shells of resin material is molded with a pair of funnels that are used to help fill the shells with the insulation material. One of the funnels in each of the double-walled shells (the larger of the two) guides insulation material into the shell. The other funnel allows air to escape from the shell while the shell is being filled. Air gaps between the insulation material and the resin shells are prevented by overfilling the shells so that the insulating material rises a considerable height (i.e., two centimeters or more) within each funnel.

Escutcheons can be mounted over the funnels immediately after the shells are filled. The escutcheons are made with stakes having "mushroomed" or other shaped ends or mechanical attachments (such as speed nuts, lock washers, and push nuts) which are inserted through the funnels and embedded in the insulation material before the insulation material has hardened in place. The stakes extend only part way through the insulation material and do not penetrate the internal shell. The escutcheons are also formed with a surrounding rim that is generally perpendicular to, and is intended to firmly abut, the face (or a raised portion of the face) of the safe lid/door or body to which the escutcheon is attached.

The escutcheon rims surround the funnels to provide a more complete vapor barrier against evaporation of water from the insulation material through the funnels. This permits the insulation material to be cured more quickly by reducing evaporative cooling and containing exothermic heat. In addition, opposite sides of the funnel have previously been designed so as to provide a "snap-fit" or similar interference engagement with mating "v" shaped detents along the outermost edge of the escutcheon rims. This, however, has not proved satisfactory in practice as there is often some shrinkage of the plastic making up the escutcheons after they are set in place in the insulating material. Since the escutcheons are anchored in the insulating material by the stakes previously described, shrinkage of the plastic making up the escutcheons can undo the snap-fit between the "v" shaped detents along the edges of the escutcheon rims and their respective funnels. This creates an undesirable and unattractive gap between the escutcheon rim and the face of the safe door/lid or body to which it is attached. This, in turn, often leads to the scrapping of the product with consequent expenses, loss of time, loss of material, and loss of revenues.

SUMMARY OF THE INVENTION

My invention improves the design and construction of funnels and escutcheons by preventing gaps from opening between the escutcheon rims and the remainder of the safe body due to the shrinking of the plastic materials forming the escutcheon. To achieve this, I make an interlock between escutcheon and funnels that cannot separate, even if the plastic shrinks. Once the escutcheon is anchored in the concrete used as insulating material, its rim is held in position by virtue of a permanent unbreakable interlock that will not allow a gap to open between the edges of the escutcheon rim and the face of the safe door or lid. This interlock is created by forming the escutcheon rim edges with projections ("locking members") that fit under overhangs ("locking grooves") formed in the funnels. Because of the shape of the locking grooves and locking members, these parts cannot be snapped together. Instead, the escutcheon is offset by a slight amount, allowing the locking members to slide down into openings that provide access to the locking grooves in the funnel as the escutcheon (with its stakes) is inserted into position. The escutcheon, with its stakes and projections, is then moved laterally (which is possible only because the concrete insulating material is still soft), sliding the locking members into the locking grooves provided. Once the escutcheon stakes are set in the concrete insulating material, such lateral movement becomes impossible. The escutcheon rim edges will maintain a firm interlocked grip with the funnels, retaining the edges in their desired position abutting the face of the safe lid/door or the safe body to which the escutcheon is attached.

DESCRIPTION OF THE DRAWINGS

FIG. 1 provides a cross-sectional schematic side view of my prior art escutcheon with the "v" shaped detents on opposite rim edges snapped into place on a funnel.

FIG. 2 provides a first perspective view, slightly from above, of the inner surface and features of an escutcheon produced in accordance with the teachings of this invention.

FIG. 3 provides a second perspective view, slightly from below, of the inner surface and features of an escutcheon produced in accordance with the teachings of this invention.

FIG. 4 provides an expanded perspective view taken from the lower corner of FIG. 2.

FIG. 5 provides a frontal view of a safe body with funnels produced in accordance with the teachings of this invention.

FIG. 6 provides a perspective view of the safe body front and funnels illustrated in FIG. 5.

FIG. 7 provides a view from above of an escutcheon produced in accordance with the teachings of this invention positioned for mating to the safe body and funnels of FIG. 6. The escutcheon is illustrated in partial cross section.

FIG. 8 provides a view from above of an escutcheon produced in accordance with the teachings of this invention in the process of being mated to the safe body and funnels of FIG. 6. The escutcheon is illustrated in partial cross section.

FIG. 9 provides a view from above of an escutcheon produced in accordance with the teachings of this invention in an intermediate position with its side rims flush against the safe body and its locking members aligned for insertion into the locking grooves provided in the funnels. The escutcheon and funnel are illustrated in partial cross section.

FIG. 10 provides a view from above of an escutcheon produced in accordance with the teachings of this invention in final position with its locking members inserted into the locking grooves provided in the funnels. The escutcheon and funnel are illustrated in partial cross section.

DESCRIPTION OF THE INVENTION

A prior art design for a top lidded fire-resistant safe is illustrated in FIG. 1. Its base (denoted generally by arrow 1) features a prior art funnel 2 adapted for placement of prior art escutcheon 3. Base 1 is a blow-molded resin body formed from an internal shell 10 and an external shell 11. The internal shell 10 encloses an interior space for storing contents of the case; and the external shell 11 forms the exterior of base 1, including prior art funnel 2. The internal shell 10 and external shell 11 also form respective interior and exterior walls that encapsulate a space (denoted generally by arrow 12) to be filled with insulating material (generally concrete).

As will be noted upon review of the drawing figure, the escutcheon rims 31 of this design are intended to firmly abut the face surfaces denoted generally by arrow 13. They are, ideally, enabled to maintain this position by virtue of the "v" shaped detents 32 on the interior edges of the opposed escutcheon rims 31. The materials forming the sides of prior art funnel 2 and escutcheon rims 31 are only semi-rigid, allowing them to deform sufficiently for detents 32 to slide/snap into undercuts 21. Unfortunately, as previously discussed, the somewhat flexible nature of the materials utilized also allows detents 32 to slide back out of undercut 21 as the materials comprising prior art escutcheon 3 shrink. This opens gaps between escutcheon rims 31 and face surfaces 13.

My new design illustrated in FIGS. 2 through 10 shares many features in common with the prior art design illustrated in FIG. 1. It also has funnels that project from the external shell 11 for filling the space 12 between the two shells with insulation. A large funnel 41 is used to guide insulating material in a liquid state into the space 12 between the internal shell 10 and the external shell 11. A small funnel 42 allows air to escape from the space 12 while the shells are filled. After filling, an escutcheon (denoted generally by arrow 50) sized to fit over both large funnel 41 and small funnel 42 is placed over and covers the funnels. In the process, stakes 30 are embedded in the insulating material filling space 12, which then hardens around stakes 30, locking the escutcheon 50 in place. The stakes 30 are typically positioned so that two fit within the large funnel 41 and the other two within small funnel 42. Each of the stakes 30 is fitted with an enlarged or "mushroomed" end that is designed to anchor the stakes 30 within the hardened insulation material in space 12. Similar parts (and the same basic process) are used in producing both the base 1 and the lid (not shown) of the fire-resistant safes that are the subject of this invention.

The manner in which the escutcheon rims 31 and face surfaces 13 are held rigidly in abutting relationship in my current invention is, however, quite different. In FIGS. 2 through 10, the escutcheon rims 31 on opposite sides of escutcheon 50 are provided with rigid locking members 51. These locking members 51 are designed to slide laterally into locking grooves (denoted by arrows 52) located on opposite sides of large funnel 41 and small funnel 42. The rigid nature of locking members 51 and locking grooves 52 does not allow them to become "unsnapped" once they have become interlocked. Thus, escutcheon 50 can no longer be pressed directly into position with detents that "snap" into position. Conversely, it can no longer be pulled directly away from large funnel 41 and small funnel 42 once locking members 51 and locking grooves 52 have become interlocked. Instead, escutcheon 50 must be moved laterally in order to "lock" or "unlock" locking members 51 and locking grooves 52.

The changes discussed above have been facilitated by other changes in the design of escutcheon 50, large funnel 41, and small funnel 42. As previously noted, escutcheon 50 cannot be inserted directly into position. It must now be offset to the side slightly (as illustrated in FIG. 7), pushed down into position abutting face surfaces 13 (as illustrated sequentially in FIGS. 8 and 9), and then moved laterally to insert locking members 51 into locking grooves 52 (as illustrated in FIG. 10). This offset, which is approximately 0.25 inches in the embodiments illustrated, requires that the length of escutcheon 50 along an axis parallel to locking grooves 52 be at least 0.25 inches more than the distance between the outside edges of large funnel 41 and small funnel 42. Finally, it is advantageous to have a plurality of locking members 51 along opposing rims 31 of escutcheon 50. This makes it necessary to create matching insertion grooves 53 in large funnel 41 and small funnel 42. Insertion grooves 53 intersect locking grooves 52 to allow the alignment of locking members 51 with locking grooves 52 prior to the lateral movement and insertion of locking members 51 into locking grooves 52.

Parts list

1 base of top lidded fire-resistant safe
2 prior art funnel
3 prior art escutcheon
10 internal shell
11 external shell
12 space filled with insulating material
13 face surfaces
21 undercuts
30 stakes
31 escutcheon rims
32 "v" shaped detents
41 large funnel
42 small funnel
50 escutcheon
51 rigid locking members
52 locking grooves
53 matching insertion grooves/locking members

I claim:

1. In a fire-resistant safe having an inner shell and an outer shell, the shells each having walls encapsulating a space to be filled with insulation material, the improvement comprising:

at least one funnel part formed by a wall of one of the shells and defining an opening for filling the encapsulated space, the funnel part comprising opposing side walls projecting outwardly from the one shell, the side walls defining an outer surface;

an escutcheon part adapted for placement over and enclosing the one funnel part, the escutcheon part having side walls defining an inner surface and an outer rim, with the outer surface of the funnel part side walls at least partially abutting the inner surface of the escutcheon part when the escutcheon part is placed over the funnel;

the surface of one of said parts defining a locking groove extending parallel to the shell wall forming the funnel part and an insertion groove extending laterally outwardly from the shell wall forming the funnel part and intersecting the locking groove, each of the grooves having a length parallel to the shell wall with the locking groove length greater than the insertion groove length; and the surface of the other of said parts defining a rigid locking member insertable into the insertion groove when the escutcheon part is placed over the funnel part and repositioned in the locking groove when the escutcheon part is moved parallel to the shell wall to a locked position, the locking member and the locking groove holding the rim of the escutcheon part firmly against the shell wall and preventing axial movement of the escutcheon part, wherein the rigid locking member cannot be removed from the locking groove in which it is placed except by movement of the rigid locking member parallel to the shell wall, and wherein the improvement includes means for preventing the rigid locking member from moving parallel to the shell wall once the escutcheon part is in the locked position.

2. The improvement as described in claim 1, wherein said escutcheon has a plurality of sides with two such sides each being adjacent to one of the two side walls on opposite sides of said opening when said escutcheon is placed over said funnel, each such side has at least one rigid locking member, and each of said rigid locking members is adapted for placement in the locking groove in the adjacent side wall when the escutcheon is placed over said one funnel.

3. The improvement as described in claim 1, further comprising at least one stake projecting from said escutcheon for anchoring the escitcheon in the insulation material.

4. The improvement as described in claim 3, wherein said one stake is inserted into said insulation material before the insulation material sets and thereafter prevents movement of said at least one rigid member.

5. The improvement according to claim 1 in which the locking groove is open at least on one end and further comprising a second rigid locking member positioned in the locking groove when the escutcheon part is moved to the locked position.

6. The improvement according to claim 1 in which the funnel part defines opposing outer surfaces and the escutcheon part defines opposing inner surfaces with the opposing surfaces of one of the parts defining opposing locking and insertion grooves and the opposing surfaces of the other of said parts defining opposing locking members.

7. The improvement according to claim 6, in which the outer surfaces of the funnel part define the locking and insertion grooves, and the inner surfaces of the escutcheon part define the locking members.

8. The improvement according to claim 6, wherein the escutcheon and funnel parts each further comprise an end wall lateral to the respective side walls, the inner surface of the escutcheon part end wall abutting the outer surface of the funnel part end wall to limit the parallel movement of the escutcheon part and thereby establish the locking position.

9. The improvement as described in claim 8, further comprising at least one anchoring element projecting from said escutcheon for anchoring the escutcheon by the insulation material.

10. The improvement as described in claim 9, wherein said anchoring element is inserted into said insulation material before the insulation material sets and thereafter prevents movement of said escutcheon.

11. In a fire-resistant safe having an inner shell and an outer shell, the shells each having walls encapsulating a space to be filled with insulation material, the improvement comprising:

at least one funnel formed by a wall of the outer shell and defining an opening for filling the encapsulated space, the funnel comprising opposing side walls projecting outwardly from the outer shell, the side walls defining opposing outer surfaces, the surfaces each defining a locking groove extending parallel to the shell wall forming the funnel; and an escutcheon adapted for placement over and enclosing the one funnel, the escutcheon having opposing side walls each defining an inner surface and an outer rim, with the outer surfaces of the funnel side walls at least partially abutting the inner surfaces of the escutcheon when the escutcheon part is placed over the funnel, the inner surfaces of the escutcheon defining opposing rigid locking members positioned in the locking grooves when the escutcheon part is moved parallel to the shell wall to a locked position, the locking members and the locking grooves holding the rims of the escutcheon firmly against the shell wall and preventing axial movement of the escutcheon, wherein the rigid locking members cannot be removed from the linear locking grooves in which they are placed except by movement of the rigid locking members parallel to the shell wall, and wherein the improvement includes means for preventing the rigid locking members from moving parallel to the shell wall once the escutcheon part is in the locked position.

12. The improvement as described in claim 11, wherein the inner surfaces of the escutcheon are on opposite sides of said funnel and each inner surface is adjacent to one of said two side walls when said escutcheon is placed over said funnel, each of said inner surfaces defines at least one rigid member projecting into an interior space defined by the side walls, and each rigid member is adapted for placement in a linear locking groove in the side wall adjacent its respective interior surface section when the escutcheon is placed over said funnel.

13. The improvement as described in claim 12, further comprising at least one insertion groove in said funnel intersecting at least one linear locking groove in said funnel.

14. The improvement as described in claim 13, wherein said at least one insertion groove has a linear portion, said linear portion defining an insertion axis perpendicular to said engagement axis.

15. In a fire-resistant safe having an inner shell and an outer shell, the shells each having walls encapsulating a space to be filled with insulation material, the improvement comprising:

a first funnel formed by a wall of the outer shell and defining an opening for filling the encapsulated space, the funnel comprising opposing side walls and at least one end wall all projecting outwardly from the one shell, the side walls defining opposing outer surfaces each defining a locking groove extending parallel to the shell wall forming the funnel;

a second funnel formed by the same wall of the outer shell and defining an opening for the escape of gases from the encapsulated space as it is being filled with the insulation material, the second funnel comprising opposing side walls and at least one end wall all projecting outwardly from the one shell, the side walls defining opposing outer surfaces each defining a locking groove extending parallel to the shell wall; and an escutcheon adapted for placement over and enclosing both funnels, the escutcheon having opposing end walls and opposing side walls each defining an inner surface and an outer rim, with one end wall abutting the end wall of one funnel and the outer surface of the side walls of both funnels at least partially abutting the inner surfaces of the escutcheon when the escutcheon part is placed over the funnels, the inner surfaces of the escutcheon defining opposing rigid locking members positioned in the locking grooves when the escutcheon part is moved parallel to the shell wall to a locked position at which the other escutcheon end wall abuts the end wall of the other funnel, the locking members and the locking grooves holding the rims of the escutcheon firmly against the shell wall and preventing axial movement of the escutcheon, wherein the rigid locking members cannot be removed from the linear locking grooves in which they are placed except by movement of the rigid locking members parallel to the shell wall, and wherein the improvement includes means for preventing the rigid locking members from moving parallel to the shell wall once the escutcheon part is in the locked position.

16. The improvement as described in claim 15, further comprising at least one insertion groove in each of the side walls of the funnels, each of the insertion grooves intersecting the respective locking groove and extending outvardly of the shell wall, each insertion grove having a width substantially the same as the width of the corresponding locking member to allow insertion of the locking member into the locking groove through the insertion groove.

17. The improvement as described in claim 15, further comprising at least one anchoring element projecting from said escutcheon through each funnel and into the encapsulated space for anchoring the escutcheon by the, insulation material.

18. The improvement as described in claim 17, wherein each anchoring element is inserted into said insulation material before the insulation material sets and thereafter prevents movement of said escutcheon.

* * * * *